US009451825B2

(12) United States Patent
Costaglia

(10) Patent No.: US 9,451,825 B2
(45) Date of Patent: Sep. 27, 2016

(54) TENSION ADJUST DEVICE FOR A CHAIR AND CHAIR

(71) Applicant: L&P PROPERTY MANAGEMENT COMPANY, South Gate, CA (US)

(72) Inventor: Massimo Costaglia, Santa Giustina in Colle (IT)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 14/436,554

(22) PCT Filed: Oct. 19, 2012

(86) PCT No.: PCT/EP2012/004402

§ 371 (c)(1),
(2) Date: Apr. 17, 2015

(87) PCT Pub. No.: WO2014/060007

PCT Pub. Date: Apr. 24, 2014

(65) Prior Publication Data

US 2015/0313362 A1 Nov. 5, 2015

(51) Int. Cl.
*A47C 1/02* (2006.01)
*A47C 1/025* (2006.01)

(52) U.S. Cl.
CPC ..... *A47C 1/025* (2013.01)

(58) Field of Classification Search
CPC ..... A47C 1/025
USPC ..... 297/463.1, 463.2
See application file for complete search history.

(56) References Cited

U.S. PATENT DOCUMENTS 6,116,695 A * 9/2000 Heidmann ..... A47C 1/023 297/463.1
2002/0084688 A1* 7/2002 Mitsuhiro ..... B60N 2/1615 297/463.1 X (Continued)

FOREIGN PATENT DOCUMENTS

EP 2116148 A1 11/2009
GB 1042181 A 9/1966

(Continued)

OTHER PUBLICATIONS

International Search Report with Written Opinion dated Feb. 8, 2013 in PCT Application No. PCT/EP2012/004402, 8 pages.

*Primary Examiner* — Anthony D Barfield
(74) *Attorney, Agent, or Firm* — Shook, Hardy & Bacon, L.L.P.

(57) ABSTRACT

A tension adjust device (20) for a chair comprises a carrier member (21), an actuation member (22), a ratchet mechanism and a disengagement mechanism. The actuation member (22) is rotatable in a first direction and in a second direction opposite to the first direction and is coupled to the carrier member (21) to rotate the carrier member (21). The ratchet mechanism (31-33) is coupled between the actuation member (22) and the carrier member (21) and comprises a locking pawl (31) and a profile (32) having a plurality of recesses for engagement with the locking pawl (31). The disengagement mechanism is configured to maintain the ratchet mechanism (31-33) in a disengaged state when the actuation member (22) rotates the carrier member (21) in the second direction. The locking pawl (31) remains disengaged from the recesses of the profile (32) while the ratchet mechanism (31-33) is in the disengaged state.

15 Claims, 7 Drawing Sheets

(56) References Cited

U.S. PATENT DOCUMENTS

2005/0099055 A1* 5/2005 Koepke ..... A47C 1/023
297/463.2
2008/0030061 A1* 2/2008 Pejathaya ..... B60N 2/4445
297/463.1
2009/0218866 A1* 9/2009 LaPointe ..... A47C 7/465
297/463.1

FOREIGN PATENT DOCUMENTS

GB 1168790 A 10/1969
WO 2004077999 A1 9/2004

* cited by examiner

TENSION ADJUST DEVICE FOR A CHAIR AND CHAIR

CROSS-REFERENCE TO RELATED APPLICATIONS

This application claims priority under 35 U.S.C. §365 to PCT/EP2012/004402, which was filed on Oct. 19, 2012. The entirety of the aforementioned application is incorporated by reference herein.

FIELD OF THE INVENTION

The invention relates to a tension adjust device for a chair and to a chair. The invention relates in particular to a tension adjust device for a chair having a chair back which exerts a force onto an occupant when the chair back is reclined, and in which the force exerted by the chair back as a function of recline angle is adjustable.

BACKGROUND OF THE INVENTION

For a wide variety of applications, chairs are nowadays provided with features which provide enhanced comfort to the person using the chair. For illustration, office-type chairs are commonly utilized in modern working environments to provide an occupant with a level of comfort while performing certain tasks that require a person to be in a seated position for an extended period of time. One common configuration for such a chair includes a mobile chair base assembly to allow the chair to roll across a floor and a pedestal column supporting the superstructure of the chair. The superstructure may include components which enable the user to adjust certain settings of the chair and to facilitate recline or "tilt" of the chair superstructure, including the back and frequently also the seat of the chair. Such a chair configuration allows users to change their sitting position in the chair as desired. Fatigue may be reduced during long sitting periods.

In recent years, chair designs have implemented a feature where a chair back exerts an increasing force onto the seat occupant as a function of recline angle during a rearward reclining movement of the chair back. The chair seat may also tilt in this process or may be displaced otherwise relative to the chair base. To this end, a spring may be provided which is compressed when the chair back reclines. The torque which must be exerted onto the chair back to maintain the chair back at a given recline angle increases as a function of recline angle. Vice versa, the force exerted onto the occupant by the chair back increases.

For enhanced comfort, it is desired that the force applied by the chair back can be adjusted. For illustration, a lightweight user may prefer a configuration which requires less force to be applied onto the chair back to recline it by a given angle. A heavier user may prefer a recline characteristics which requires him to exert a greater force onto the chair back to recline it by the same given angle. The chair may have a tension adjust system which allows the torque which must be exerted onto the chair back in a recline movement as a function of recline angle to be adjusted.

One approach to adjust a tension of a chair back subassembly is to alter an offset bias or pretension of the spring. Alternatively or additionally, a lever arm length may be adjusted. The latter approach also allows the recline characteristics to be altered in a more versatile manner. A chair back subassembly of this type is described in the PCT application PCT/EP2011/003276.

Tension adjust devices generally include an actuation member which can be manipulated by a person sitting on a chair to adjust the tension. The actuation member, which may be coupled to a gripping part for manual actuation by a user, may be rotatable in a first direction for increasing the tension and in an opposite second direction for decreasing the tension. Problems may occur when the energy stored in the energy storage mechanism is suddenly increased while the user still rotates the actuation member to increase the tension. This may occur when the user reclines while still turning the gripping part for increasing the tension. In this case, there may be an undesired back action from the energy storage mechanism, which may cause the gripping part to move rapidly and in an uncontrolled way.

Various approaches have been suggested to lock off the movement of the handle from the energy storage mechanism to prevent such undesired rapid movement of the handle. Many of these approaches rely on frictional forces. For illustration, by using a screw thread with a small pitch for increasing or decreasing a pretension of spring, the friction in the thread may prevent the handle from moving under the action of the spring even when the user reclines during the adjustment process. A drawback of such an approach is that the pitch of the screw thread must be small to reliably lock off the movement of the handle from a sudden increase in energy in the spring. This is turn means that a fairly large number of rotations is required to adjust the spring preload from its minimum to its maximum value or vice versa. Other mechanisms which rely on friction, e.g. self-locking gearings, may significantly add to the complexity, costs and construction space requirements of the adjustment mechanism, which is undesirable.

SUMMARY

Accordingly, there is a continued need in the art for a tension adjust device and a chair which address some of the above needs. There is a need in the art for a tension adjust device and a chair which allows an adjustment between minimum and maximum tension to be made with a small number of rotations of an actuation member, while reliably preventing the actuation member from spinning in an uncontrolled way when energy stored in an energy storage mechanism increases suddenly. There is a need in the art for such a tension adjust device which has a simple construction.

According to an embodiment, a tension adjust device is provided. The tension adjust device is configured for adjustment of a tension applied by a chair back or other chair component. The tension adjust device comprises a carrier member and an actuation member which is rotatable in a first direction and in a second direction opposite to the first direction. The actuation member is coupled to the carrier member to rotate the carrier member. The tension adjust device comprises a ratchet mechanism coupled between the actuation member and the carrier member, the ratchet mechanism comprising a locking pawl and a profile having a plurality of recesses for engagement with the locking pawl. The tension adjust device comprises a disengagement mechanism configured to maintain the ratchet mechanism in a disengaged state when the actuation member rotates the carrier member in the second direction, the locking pawl remaining disengaged from the recesses of the profile while the ratchet mechanism is in the disengaged state.

The tension adjust mechanism uses a ratchet mechanism to lock off the actuation member from a back action of a spring or other energy storage mechanism when the actuation member is rotated in the first direction to increase tension. It is not required to rely on a small pitch and high friction of a screw thread to suppress a back action onto a handle when the user reclines while he simultaneously rotates the handle to increase tension. The disengagement mechanism ensures that the ratchet mechanism does not interfere with a tension decrease operation when the actuation member is rotated in the second direction. I.e., the ratchet mechanism is selectively deactivated when the actuation member rotates the carrier member in the second direction for tension decrease, while the ratchet mechanism is operative to prevent an undesired rotation of the actuation member when the actuation member rotates the carrier member in the first direction for tension increase.

The tension adjust mechanism has a simple construction, which allows it to be accommodated in a small construction space. The tension adjust mechanism may be integrated into a handle, e.g., a handle which is attached below a seat surface of the chair.

The disengagement mechanism may selectively act onto the ratchet mechanism such that it maintains the ratchet mechanism in the disengaged state in which the locking pawl cannot enter into recesses of the profile while the actuation member rotates the carrier member in the second direction, while allowing the locking pawl to enter into recesses of the profile while the actuation member rotates the carrier member in the first direction.

The carrier member may carry an output shaft of the tension adjust mechanism. The output shaft may be coupled to an adjustable subassembly of the chair to increase a pretension or lever arm length of an energy storage mechanism. The output shaft may be attached to the carrier member in a torque-prove manner or may be integrally formed with the carrier member. The tension adjust device may comprise an energy storage mechanism which applies a force onto a moveable component of the chair, with the output shaft being coupled to the energy storage mechanism.

The actuation member may be displaceable relative to the carrier member between a first relative position and a second relative position. The disengagement mechanism may be configured to maintain the ratchet mechanism in the disengaged state while the actuation member is in the second relative position relative to the carrier member.

The actuation member may be rotatable relative to the carrier member. The disengagement mechanism may be configured to transfer the ratchet mechanism into the disengaged state when the actuation member is rotated into the second relative position relative to the carrier member. The disengagement mechanism may be configured to allow the locking pawl to enter into recesses of the profile when the actuation is in the first relative position relative to the carrier member.

The disengagement mechanism may comprise a surface formed on the actuation member and configured to displace the locking pawl when the actuation member is rotated into the second relative position relative to the carrier member. The surface may have a distance from a rotation axis of the actuation member which varies in a circumferential direction about the rotation axis.

One of the actuation member and the carrier member may have a projection, and the other one of the actuation member and the carrier member may have a first end stop and a second end stop. The projection may abut on the first end stop when the actuation member is in the first relative position relative to the carrier member and the projection may abut on the second end stop when the actuation member is in the second relative position relative to the carrier member. This configuration allows the actuation member to rotate the carrier member when the projection abuts on one of the end stops.

The actuation member and the carrier member may have a common rotation axis. The projection may be curved about the rotation axis and may protrude into a guide recess which is curved about the rotation axis. The first end stop may be a first end surface of the guide recess and the second end stop may be an opposing second end surface of the guide recess. The guide recess may extend through an angle which is greater than an angle through which the projection extends about the rotation axis. The guide recess may extend through an angle about the rotation axis which is equal to or greater than the angle through which the projection extends about the rotation axis plus the angle through which one recess of the profile extends about the rotation axis. Thereby, back action onto the actuation member may be reduced further.

The carrier member may carry the locking pawl. The locking pawl may be biased in a direction perpendicular to the common rotation axis of actuation member and carrier member. Alternatively, the carrier member may also carry the profile.

The profile may be formed on an inner surface of a lock ring. The lock ring may have attachment features for fixedly attaching the lock ring to a chair and, in particular, to a side wall of an adjustable subassembly of a chair. The carrier member may be arranged in a cavity defined between the actuation member and the lock ring. The actuation member may be mounted so as to be rotatable relative to the lock ring.

According to another embodiment, there is provided a chair which includes a base, an adjustable subassembly and the tension adjust device of any one aspect or embodiment. The adjustable subassembly may comprise a chair component which is moveable relative to the base and an energy storage mechanism coupled to the chair component. The tension adjust device may be coupled to the adjustable subassembly to adjust a tension of the adjustable subassembly.

The tension adjust device may be integrated into a handle which projects from the adjustable subassembly. The adjustable subassembly may comprises a lateral side wall, and the handle with the tension adjust device may be attached at an outer side of the lateral side wall. The tension adjust device may be attached to the adjustable subassembly in such a manner that the actuation member, the carrier member, the ratchet mechanism and the disengagement mechanism may all be positioned at an outer side of the lateral side wall. No construction space needs to be reserved in a core of the adjustable subassembly for these components of the tension adjust mechanism.

The tension adjust device may be coupled to the adjustable subassembly to increase a tension of the adjustable subassembly when the actuation member rotates the carrier member in the first direction and to decrease the tension of the adjustable subassembly when the actuation member rotates the carrier member in the second direction.

The tension adjust device may be coupled to the energy storage mechanism and may be configured to adjust a pretension and/or a lever arm length of the energy storage mechanism.

The chair component that is moveable may be a chair back. The adjustable subassembly may further comprise a back bracket tiltably supported on the base and attached to the chair back, and a rocker. The rocker may have a pivot axis provided at a fixed location relative to the rocker and may be coupled to the back bracket so as to be moveable relative to the back bracket. The rocker may be configured such that the rocker pivots about the pivot axis when the back bracket tilts relative to the base. The energy storage mechanism may be coupled to the rocker to exert a force onto a portion of the rocker, the portion being spaced from the pivot axis by a distance. An adjustable subassembly having such a configuration provides a convenient recline path of the chair back.

The tension adjust device may be coupled to at least one of the rocker or the energy storage mechanism and may be configured to alter the distance between the pivot axis and the portion of the rocker at which the force is exerted onto the rocker. By adjusting the lever arm length, i.e. the distance between the pivot axis and the portion of the rocker at which the force is exerted onto the rocker, the recline characteristics can be adjusted in an efficient and versatile manner. Alternatively or additionally, the tension adjust mechanism may also adjust a pretension of the energy storage mechanism, i.e., the energy stored in the energy storage mechanism when the chair back is in the frontmost position.

The tension adjust devices and chairs according to embodiments may be utilized for various applications in which it is desired to adjust a subassembly of a chair. Examples include the adjustment of a recline characteristics of a chair back, e.g. in office furniture.

BRIEF DESCRIPTION OF THE DRAWINGS

Embodiments of the invention will be described with reference to the accompanying drawings.

DETAILED DESCRIPTION OF EMBODIMENTS

Figure 1:
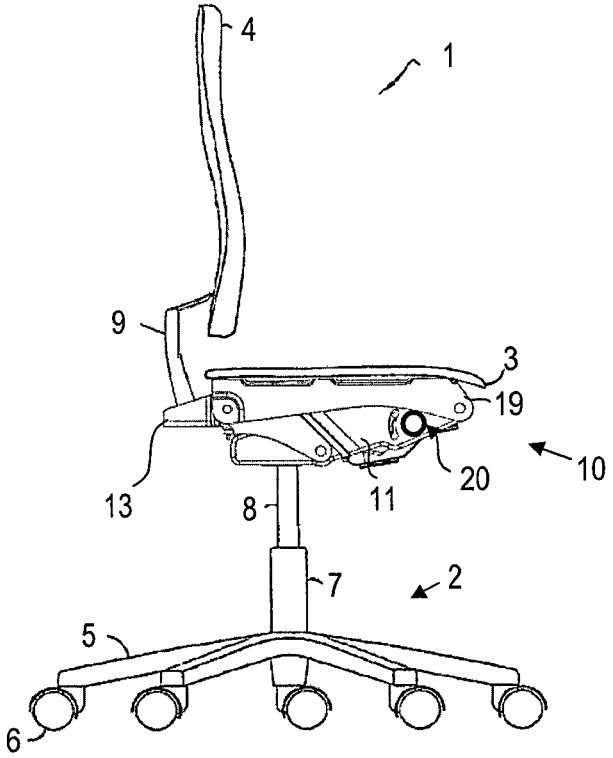
FIG. 1 is a side view of a chair having an adjustable recline subassembly, which is configured as a tilt mechanism, and a tension adjust device according to an embodiment.

Exemplary embodiments of the invention will be described with reference to the drawings. While some embodiments will be described in the context of specific fields of application, such as in the context of an office-type chair, the embodiments are not limited to this field of application. The features of the various embodiments may be combined with each other unless specifically stated otherwise. Throughout the following description, same or like reference numerals refer to same or like components or mechanisms.

According to embodiments, a tension adjust device is provided. The tension adjust device is configured to adjust a tension of an adjustable subassembly of the chair.

The adjustable subassembly may be an adjustable recline subassembly, in which the chair back provides an increasing force as a function of recline angle. The characteristics of the recline subassembly, i.e. the force as a function of recline angle, may be adjusted using the tension adjust device. The tension adjust device may be a quick adjust mechanism which allows the user to adjust the recline characteristics all the way from the softest to the hardest characteristics by at most three full turns of an actuation member. The tension adjust device may be integrated into a handle which is attached to a base of the chair.

FIG. 1 shows a chair 1 which includes an adjustable recline mechanism 10 and a tension adjust device 20 coupled thereto. The chair 1 is illustrated to be an office-type chair having a chair base assembly 2 and a superstructure. The superstructure includes a chair seat 3, a chair back 4 and the adjustable recline mechanism 10 to which the chair seat 3 and chair back 4 are connected. The adjustable recline mechanism 10 may be configured to effect a coordinated movement of the back 4 and the seat 3. The base assembly 2 includes a pedestal column 7, a number of support legs 5 extending radially from the column 7 and a corresponding number of castors 6 operably supported on the outer ends of the support legs 5. A gas cylinder or other lifting mechanism may be supported by the column 7 to enable the height of the seat 3, and thus of the chair superstructure, to be adjusted by an occupant.

The adjustable recline mechanism 10 is operative to apply an increasing torque onto the chair back 4 as the chair back 4 is reclined, which in turn causes the chair back 4 to exert a force onto the occupant which increases with recline angle. The adjustable recline mechanism 10 may be configured to implement a coordinated movement of the seat 3 and of the back 4 when the back 4 is tilted. The adjustable recline mechanism 10 includes a base 11 which, in the installed state of the adjustable recline mechanism in which the adjustable recline mechanism 10 is incorporated into the chair 1, is coupled to the pedestal column 7 or another component of the chair base assembly. The adjustable recline mechanism 10 includes a back bracket 13 which, in the installed state of the adjustable recline mechanism 10, is attached to the chair back 4. The chair back 4 may be fixedly attached to the back bracket 13, e.g. at a vertically extending strut 9. The back bracket 13 may be pivotably attached to the base 11. The adjustable recline mechanism 10 comprises an energy storage mechanism which exerts a force onto the chair back 4, thereby providing a counterforce against the recline movement of the chair back 4. The adjustable reclines mechanism 10 may include a rocker coupled to the back bracket 13, and the energy storage mechanism may exert a force onto the rocker, which in turn acts onto the back bracket 13.

The chair 1 comprises a tension adjust device 20 which allows a geometrical arrangement of the rocker and energy storage mechanism and/or a pretension of a spring to be modified. This allows the recline characteristics of the adjustable recline mechanism 10 to be adjusted.

The tension adjust device 20 according to an embodiment generally comprises a carrier member, an actuation member, a ratchet mechanism coupled between the carrier member and the actuation member, and a disengagement mechanism. The carrier member may carry a shaft or another component that is coupled to the adjustable recline mechanism 10. The carrier member may also carry a locking pawl or other component of the ratchet mechanism. The actuation member is mounted so as to be rotatable in a first direction for increasing tension and in a second direction for decreasing tension. The actuation member is coupled to the carrier member such that the actuation member rotates the carrier member in the first or second directions, together with the actuation member and depending on the direction in which the actuation member is rotated. The ratchet mechanism is coupled between the actuation member and the carrier member and is configured such that, when the actuation member rotates the carrier member in the first rotation direction, the ratchet mechanism prevents a reverse rotation of the actuation member. Thereby, an undesired back action of the adjustable recline mechanism onto the actuation member of the tension adjust device 20 may be suppressed or eliminated when the chair back 4 is reclined while the user is still in the process of turning the actuation member to increase the tension.

In order to allow a tension decrease operation to be performed, the disengagement mechanism selectively disengages the ratchet mechanism depending on a rotation direction of the actuation member and the carrier member. When the actuation member is rotated in the second direction for tension decrease, the disengagement mechanism transfers the ratchet mechanism into a disengaged stated in which the locking pawl is retracted such that it cannot enter into recesses of a profile of the ratchet. The disengagement mechanism maintains the ratchet mechanism in the disengaged state while the tension decrease operation is being carried out, thereby ensuring that the ratchet mechanism does not interfere with the rotation of the actuation member and carrier member in the second rotation direction. On the other hand, when the actuation member is rotated in the first direction for tension increase, the disengagement mechanism does not prevent the locking pawl from entering into recesses of the profile of the ratchet mechanism. The ratchet mechanism is operative to prevent undesired back action of the adjustable recline mechanism 10 through the carrier member onto the actuation member by locking the carrier member against rotation in the second direction, while the actuation member is rotated in the first direction.

The actuation member and the carrier member may be rotatable relative to each other by a pre-determined angle. Depending on whether the actuation member is in a first or second relative position relative to the carrier member, the disengagement mechanism may place the ratchet mechanism into the disengaged state or back into the normal operative state. By providing a small rotational play between the actuation member and the carrier member, various effects can be attained. Firstly, the disengagement mechanism may be realized with a simple structure in which a relative movement between actuation member and carrier member brings the locking pawl out of engagement with the profile or back into engagement with the profile. Secondly, during a tension increase operation, a small return movement of the carrier member into the second direction which may continue through a small angle until the locking pawl locks the carrier member against further movement does not necessarily cause a corresponding movement of the actuation member. Undesired back action onto the user may be reduced.

The tension adjust device 20 may be a quick adjust device which allows the full range of adjustments, i.e. from the softest to the hardest tension and vice versa, to be made with at most three full turns of the actuation member. The tension adjust device 20 may be coupled to a cam, e.g. to a snail cam, of the adjustable recline mechanism 10 such that the cam is driven through its full movement range with a low number of full turns, e.g. at most three full turns, of the actuation member. The tension adjust device 20 may be coupled to a thread, e.g. to a screw thread, of the adjustable recline mechanism 10 such that the thread is driven through its full axial movement range with a low number of full turns, e.g. at most three full turns, of the actuation member. The tension adjust device 20 may be coupled to the adjustable recline mechanism 10 such that it adjusts a pretension of a spring or of another energy storage mechanism. The tension adjust device 20 may be coupled to the adjustable recline mechanism 10 such that it adjusts a lever arm length at which the energy storage mechanism applies a force onto a pivotable component of the chair.

The tension adjust device 20 may be integrated into a handle. The handle may project from the base 11 and, in particular, from a side wall of the base 11. The handle may be attached at an outer face of a side wall of the base 11.

The construction and operation of a tension adjust device 20 of an embodiment will be described in detail with reference to FIG. 2 to FIG. 13.

Figure 2:
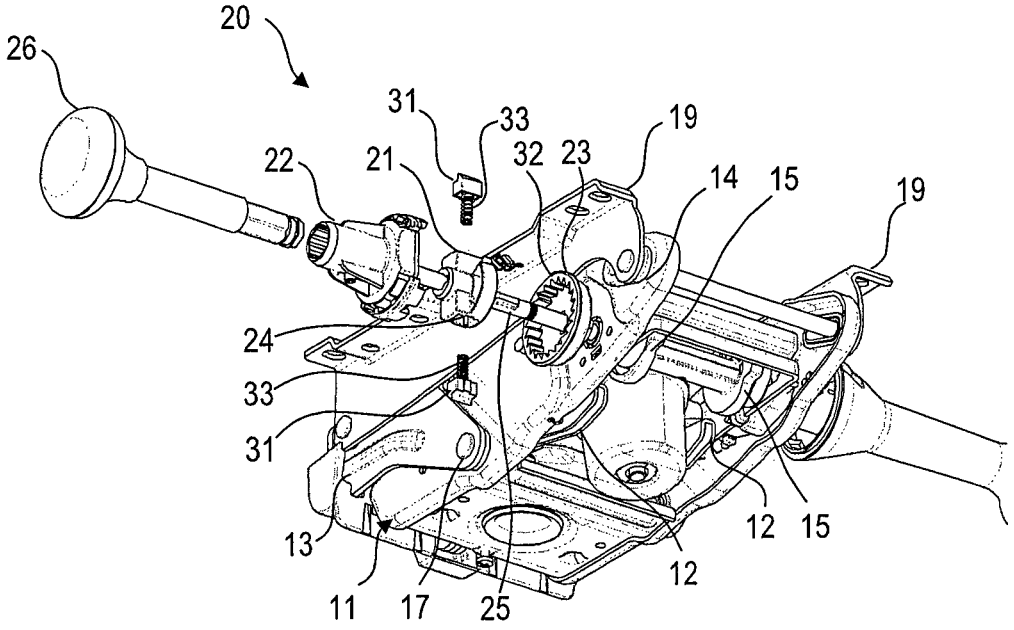
FIG. 2 is an exploded perspective view of components of the adjustable recline subassembly and the tension adjust device according to an embodiment.

FIG. 2 shows an adjustable subassembly which is an adjustable recline mechanism 10 and a tension adjust device 20 coupled thereto. The tension adjust device 20 is shown in exploded view. The tension adjust device 20 may be used for a wide variety of adjustable chair subassemblies, without being limited to adjustable recline mechanisms. For illustration rather than limitation, there is shown an adjustable recline mechanism which includes the base 11, a back bracket 13 which is pivotably coupled to the base 11 at a tilt axis 17, and a rocker 12. The rocker 12 is pivotably supported on the base 11. An energy storage mechanism, e.g. a spring (not shown in FIG. 2), exerts a force onto the rocker 12 at a portion of the rocker 12 which is spaced from its pivot axis. The rocker 12 has an interface which exerts a force onto a portion of the back bracket 13, thereby providing increasing torque as the back bracket 13 tilts about the tilt axis 17. Recline of the back bracket 13 causes the rocker 12 to pivot relative to the base 11, thereby increasing or decreasing the force applied by the energy storage mechanism onto the rocker 12 and, thus, the torque applied onto the back bracket 13.

In an adjustable subassembly having such a configuration, the tension adjustment may be made by adjusting a pretension of the energy storage mechanism and/or the geometry, in particular the lever arm length. A cam 15 may be driven to adjust the pretension and/or lever arm length. Rotation of the cam 15 may axially displace an axial end of a spring and/or may displace the spring and the rocker 12 relative to each other, thereby altering the position at which the spring acts onto the rocker 12. A seat support bracket 19 may also be provided, so as to cause the seat surface 3 to also move when the seat back 4 is reclined.

It will be appreciated that the specific configuration of the adjustable subassembly is not germane to the construction and operation of the tension adjust device 20. The tension adjust device 20 may be used in combination with a wide variety of different adjustable chair subassemblies.

The tension adjust device 20 includes a carrier member 21, an actuation member 22, and a ratchet mechanism having at least one locking pawl 31 and a profile 32 with recesses. A gripping part 26 may be attached to or integrally formed on the actuation member 22. The gripping part 26 and the actuation member 22 may be attached to each other in a torque-proof manner. The carrier member 21 may carry a shaft 25 which extends into the core mechanism located in an interior of the base 11.

The ratchet mechanism may include two locking pawls 31. Other numbers of locking pawls, e.g. one or at least three locking pawls, may be used in other embodiments. The locking pawls 31 are supported in the carrier member 21 so as to be displaceable in a direction perpendicular to a rotation axis of the actuation member 22 and the carrier member 21. The carrier member 21 may have a recess 24 in which part of a locking pawl 31 is disposed. A resiliently deformable bias means, e.g. a spring 33, may also be arranged in the recess 24 to bias the locking pawl 31 towards the profile 32. The profile 32 may be a toothed profile, having recesses of triangular shapes and corresponding teeth projecting towards the rotation axis of the actuation member 22 and the carrier member 21. The profile 32 may be formed on an inner surface of a lock ring 23. The lock ring 23 may be fixedly attached to a side 14 of the base 11.

Each locking pawl 31 is positioned such and has a length in an axial direction (i.e., the direction along the rotation axis of the carrier member and actuation member) which is sufficiently large that the locking pawl 31 overlaps with both the profile 32 and the actuation member 22 in an axial direction. I.e., one part of an outer surface of each locking pawl 31 faces the profile 32, while another part of the outer surface of the locking pawl faces an inner surface of the actuation member 22. This allows the actuation member 22 to displace the locking pawls 31 in a direction perpendicular to the rotation axis, thereby moving the locking pawls to a disengaged state in which they cannot enter into recesses of the profile 32. This displacement of the locking pawls 31 may be attained by a small rotation of the actuation member 22 relative to the carrier member 21.

Figure 3:
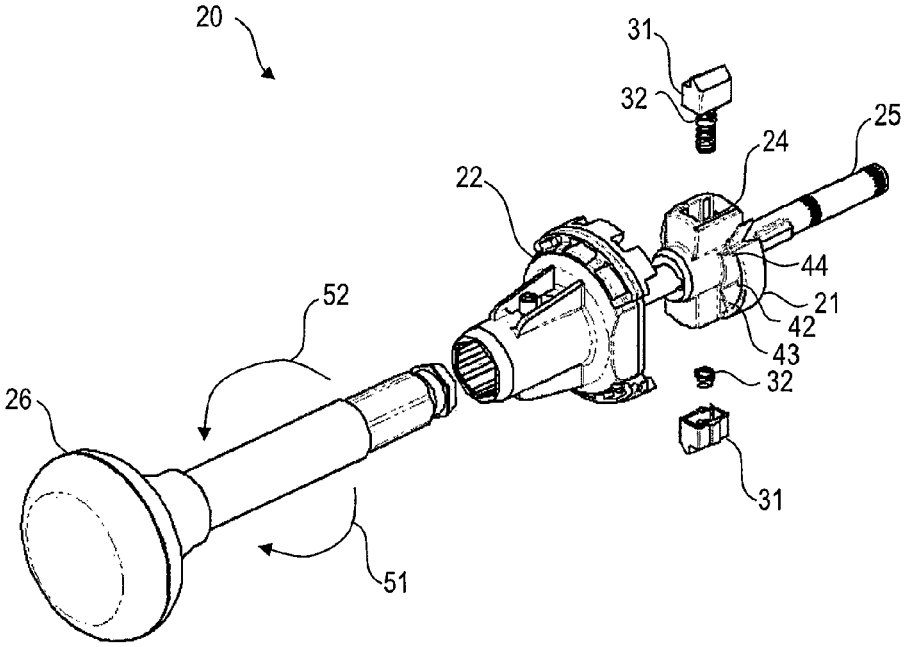
FIG. 3 and FIG. 4 are exploded perspective views of the tension adjust device according to an embodiment.
Figure 4:
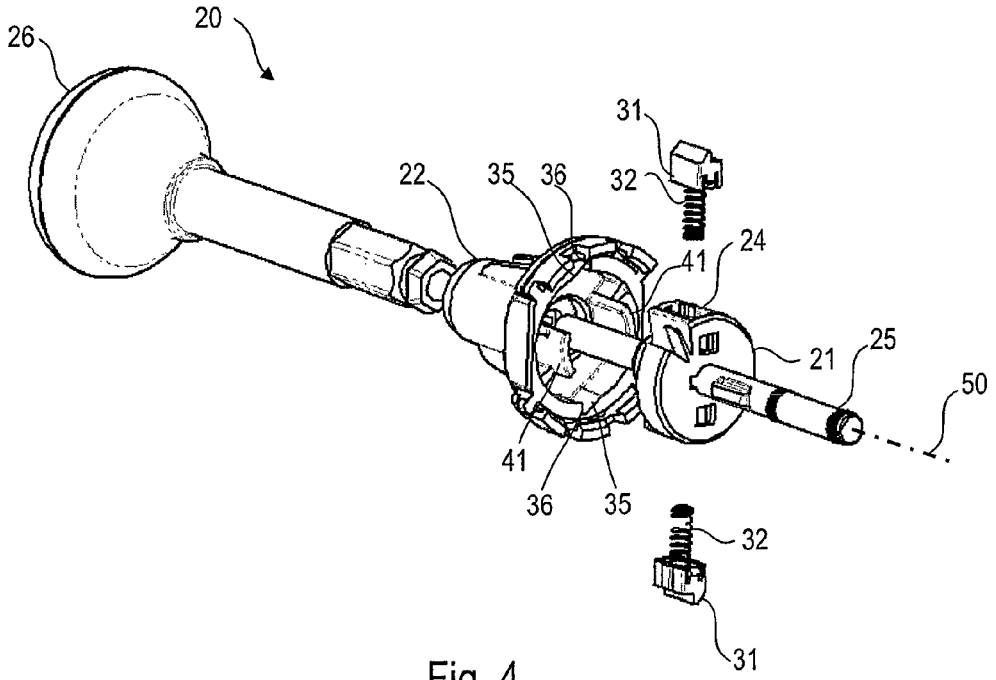

FIG. 3 and FIG. 4 show exploded perspective views of the locking device 20 from different perspectives. The operation of the ratchet mechanism and the disengagement mechanism will be explained in more detail with reference to FIG. 3 and FIG. 4.

The actuation member 22 is rotatable about a rotation axis 50, which is also the rotation axis of the carrier member 21. The actuation member 22 is coupled to the carrier member 21 so as to cause the carrier member 21 to rotate with the actuation member 22 when the user rotates the actuation member 22 through a larger angle. To this end, one of the actuation member 22 and the carrier member 21 has a projection and the other one has an abutment surface and preferably at least two spaced abutment surfaces on which the projection can abut. In the illustrated implementation, the actuation member 22 has a projection 41. Another projection 41 or plural additional projections may be provided. As shown in FIG. 4, the actuation member 22 may have two projections 41 in diametrically opposed arrangement. The projection(s) 41 may extend along a circular section about the rotation axis 50. The carrier member 21 has a corresponding recess 42 or corresponding recesses 42. A first end 43 and opposing second end 44 of each recess 42 act as abutment surfaces on which the respective projection 41 may abut to force the carrier member 21 to rotate jointly with the actuation member 22. The recess(es) 42 may extend along a circular section about the rotation axis 50. The recess(es) 42 may extend through an angle which is greater than an angle through which the projection(s) 41 extend about the rotation axis 50. This provides a rotational play between the actuation member 22 and the carrier member 21, which is used in selectively disengaging locking pawls from the profile in dependence on the rotation direction. The difference between the two angles may be equal to or greater than the angle enclosed by one recess of the profile 32 relative to the rotation axis 50.

When the actuation member 22 is rotated in a first direction 51, the projection 41 abuts on the first end 43 of the recess 42. During continued rotation of the actuation member 22 in the first direction 51, each projection 41 abutting on the respective first end 43 of the recess 42 forces the carrier member 21 to rotate with the actuation member 22. The relative position between the actuation member 22 and the carrier member 21 in which the projection 41 abuts on the first end 43 of the recess 42 is also referred to as first relative position herein.

When the actuation member 22 is in the first relative position relative to the carrier member 21, the part of each locking pawl 31 that axially overlaps with the inner surface of the actuation member 22 can enter into a recess 36 formed on the inner surface of the actuation member 22. The recess 36 is dimensioned such that the locking pawl 31, when it enters into the recess 36, may also engage with teeth of the profile 32. As long as the actuation member 22 is in the first relative position relative to the carrier member 21, the geometry of the inner surface of the actuation member 22 does not prevent the locking pawl(s) 31 from engaging recesses of the profile 32. The ratchet mechanism is in an operative state in which it prevents the carrier member 21 and, thus, the actuation member 22 from being rotated in a second direction 52 by a torque provided by the shaft 25. The ratchet mechanism does, however, not prevent the carrier member 21 to rotate in the first direction 51 under the action of the actuation member 22, because the profile 32 and locking pawls 31 are shaped so as to allow the locking pawls 31 to slide over the teeth of the profile 32 in this movement direction. I.e., the ratchet mechanism is configured such that it permits rotation of the carrier member in the first direction, but locks the carrier member against rotation in the second direction unless the ratchet mechanism is disengaged by the disengagement mechanism which will be explained in more detail below. The resulting rotation of the shaft 25 in the first direction 51 may adjust a pretension of an energy storage mechanism and/or a leverage arm such that the tension increases.

When rotation of the actuation member 22 in the first direction 51 is stopped and the user starts to rotate the actuation member 22 in the second direction 52 for tension decrease, the actuation member 22 first rotates relative to the carrier member 21 until the projection 41 abuts on the second end 44 of the recess 42. The relative position between the actuation member 22 and the carrier member 21 in which the projection 41 abuts on the second end 44 of the recess 42 is also referred to as second relative position herein.

When the actuation member 22 is transferred from the first relative position to the second relative position relative to the carrier member 21 (which happens at the beginning of a tension decrease operation), the part of each locking pawl 31 that axially overlaps with the inner surface of the actuation member 22 slides along a surface portion 35 on the inner surface of the actuation member 22. This surface portion 35 has a distance from the rotation axis 50 which varies in a circumferential direction. I.e., the surface portion 35 does not extend at equal distance from the rotation axis 50, but may be a planar or arcuate surface portion on the inner surface of the actuation member 22 which extends from a first distance to a second distance from the rotation axis 50. The first distance, at recess 36, is greater than an inner diameter of the profile 32, thereby allowing the locking pawl 31 to snap into one of the recesses of the profile 32. The second distance, adjacent to recess 36, is smaller than the inner diameter of the profile 32, thereby preventing the locking pawl 31 from snapping into the recesses of the profile when the locking pawl is positioned on this section of the surface portion 35 such that the locking pawl 31 is depressed by the surface portion 35.

The movement of the surface portion 35 along the locking pawl 31, which occurs while the actuation member 22 is transferred from the first relative position to the second relative position relative to the carrier member 21, forces the locking pawl(s) 31 out of engagement with the profile 32. The surface portion 35 depresses the associated locking pawl 31, thereby ensuring that the locking pawl 31 cannot enter any recesses of the profile 32. Thereby, the ratchet mechanism is set to a disengaged state. The ratchet mechanism does not lock the carrier member 21 and, thus, the actuation member 22 from rotating in the second direction 52, because the ratchet mechanism remains in the disengaged state as long as the user exerts a torque causing the actuation member and carrier member to rotate in the second direction 52.

It will be appreciated that the tension adjust device 20 has a simple configuration. This allows the tension adjust device 20 to be installed in a small construction space. For illustration, and as shown in FIG. 2, the tension adjust device 20 may be integrated into a handle. The actuation member 22, the carrier member 21, the ratchet mechanism and the disengagement mechanism may all be positioned at an outer side of the base 11.

The geometry of the actuation member 22 is matched to the geometry of the profile 32 of the ratchet mechanism. The recess 36 is dimensioned such that, when the locking pawl 31 enters into the recess 36, it may also engage with teeth of the profile 32. As long as the actuation member 22 is in the first relative position relative to the carrier member 21, the geometry of the inner surface of the actuation member 22 does not prevent the locking pawl(s) 31 from engaging recesses of the profile 32. The ratchet mechanism is in an operative state in which it prevents the carrier member 21 and, thus, the actuation member 22 from being rotated in a second direction 52 by a torque provided by the shaft 25. The ratchet mechanism does, however, not prevent the carrier member 21 to rotate in the first direction 51 under the action of the actuation member 22, because the profile 32 and locking pawls 31 are shaped so as to allow the locking pawls 31 to slide over the teeth of the profile 32 in this movement direction. The recess 36 has a position on the inner circumference of the actuation member 22 which is matched to the position of the projection(s) 41 and/or the position of the first end stop 43, such that the locking pawl 31 is positioned radially inwardly of the recess 36 when the projection 41 abuts on the first end 43, i.e., when the actuation member 22 is in the first relative position relative to the carrier member 21.

When the user starts to rotate the actuation member 22 in the second direction, teeth of the profile 32 initially prevent rotation of the carrier member 21. The actuation member 22 is rotated relative to the carrier member 21 from the first relative position to the second relative position. During this process, the surface portion 35 slides along the locking pawl 31 and brings the locking pawl out of engagement with the profile 32. The surface portion 35 may depress the locking pawl 31 into the corresponding recess 24 in the carrier member 21. The surface portion 35 is dimensioned such that, when the projection 41 abuts on the second end stop 44, i.e., when the actuation member 22 is in the second relative position relative to the carrier member 21, the surface portion 35 has moved the locking pawl 31 into a position in which it can no longer engage with recesses of the profile. Accordingly, the teeth of the profile 32 do not prevent the carrier member 21 from rotating. The actuation member 22 can rotate the carrier member 22 in the second direction, e.g. to perform a tension decrease operation. The resulting rotation of the shaft 25 in the second direction 52 may adjust a pretension of an energy storage mechanism and/or a leverage arm such that the tension decreases.

When the user stops rotating the actuation member 22 in the second direction, the part of the locking pawl 31 which axially overlaps with the actuation member 22 may slide along the surface portion 35, thereby slightly rotating the actuation member 22. In the rest state, the locking pawl 31 may be positioned so as to protrude both into the recess 36 of the actuation member 22 and into one of the recesses of the profile 32.

While the structure of the tension adjust device has been explained mainly with reference to a locking pawl and corresponding recess on the actuation member, it will be appreciated that two locking pawls (as shown in FIG. 2 to FIG. 4) or even greater numbers of locking pawls may be used.

The operation of the tension adjust device will be explained in more detail with reference to FIG. 5 to FIG. 13.

Figure 5:
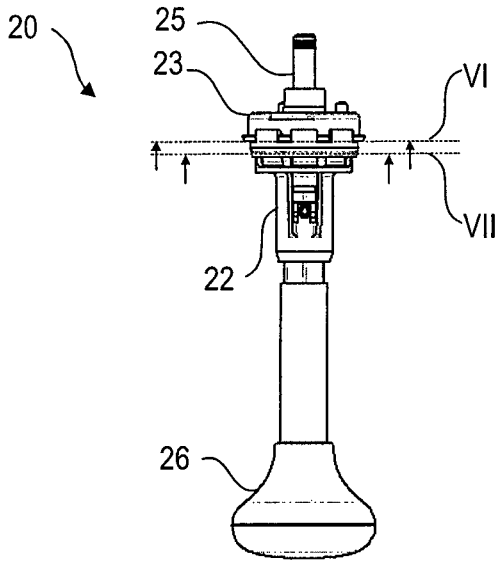
FIG. 5 is a plan top view of the tension adjust device according to an embodiment.

FIG. 5 shows a plan view of the tension adjust device 20. The carrier member 21 is housed in a cavity defined by the actuation member 22 and the lock ring 23. Sectional planes VI and VII are also shown.

Figure 6:
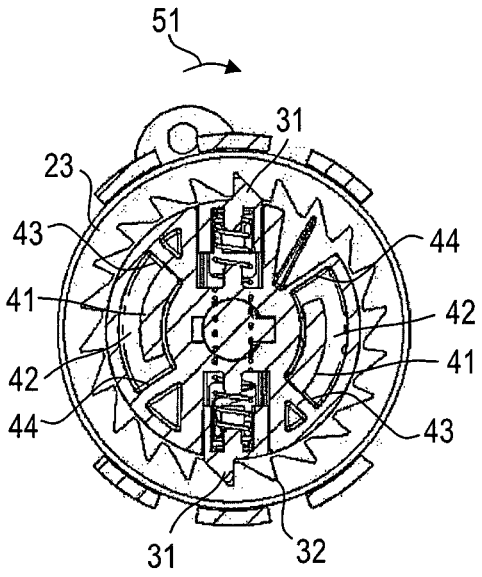
FIG. 6 is a cross-sectional view of the tension adjust device of FIG. 5 in a plane VI indicated in FIG. 5 during a tension increase operation.
Figure 7:
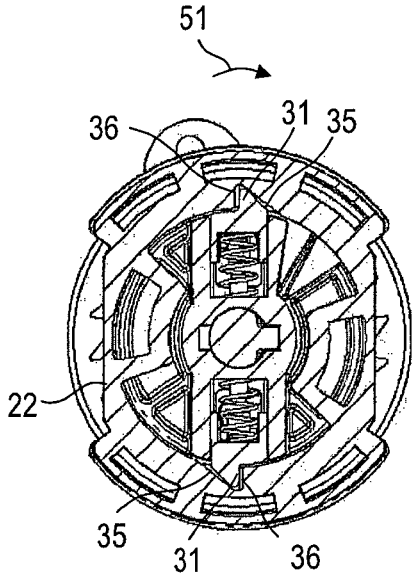
FIG. 7 is a cross-sectional view of the tension adjust device of FIG. 5 in a plane VII indicated in FIG. 5 during the tension increase operation.

FIG. 6 is a sectional view along plane VI of FIG. 5 when the actuation member 22 is in the first relative position relative to the carrier member 21. The projection 41 abuts on the first end 43, which acts as a first abutment surface. FIG. 7 is a sectional view along plane VII of FIG. 5 when the actuation member 22 is in the first relative position relative to the carrier member 21. In a circumferential direction, each locking pawl 31 is positioned radially inwardly of the corresponding recess 36 on the inner surface of the actuation member 22. The actuation member 22 allows the locking pawl to snap into corresponding recesses of the profile 32, as shown in FIG. 6. The tension adjust device is in such a condition during a tension increase operation, for example. The actuation member 22 can rotate the carrier member 21 in the first direction, thereby causing the shaft 25 to rotate in the first direction, while the ratchet mechanism blocks a return rotation of the carrier member 21 through extended angles in the opposite second direction. Even when the energy storage mechanism of the adjustable subassembly causes the carrier member 21 to rotate slightly in the second direction until a tooth of the profile 32 engages the locking pawl 31, this movement does not necessarily translate into a corresponding rotation of the actuation member 22, but may only cause the recess 42 to be displaced relative to the projection 41 until the projection 41 abuts on the second end 44 of the recess 42.

Figure 8:
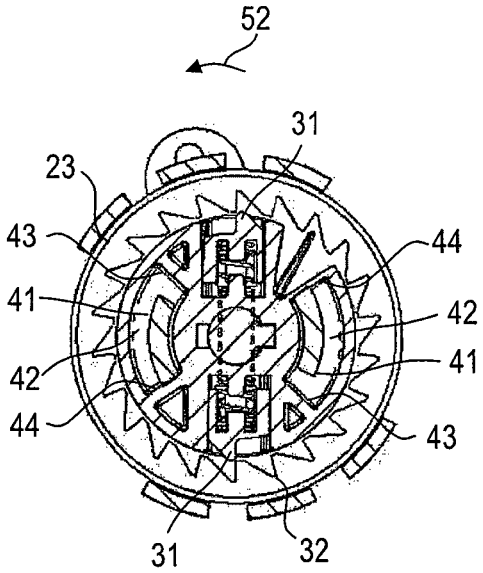
FIG. 8 is a cross-sectional view of the tension adjust device of FIG. 5 in a plane VI indicated in FIG. 5 during a tension decrease operation.
Figure 9:
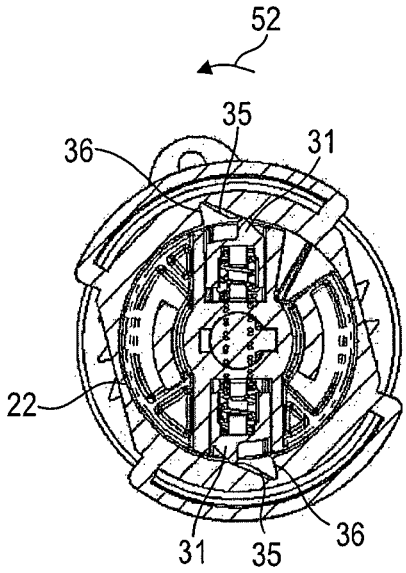
FIG. 9 is a cross-sectional view of the tension adjust device of FIG. 5 in a plane VII indicated in FIG. 5 during the tension decrease operation.

FIG. 8 is a sectional view along plane VI of FIG. 5 when the actuation member 22 is in the second relative position relative to the carrier member 21. The projection 41 abuts on the second end 44, which acts as a second abutment surface. FIG. 9 is a sectional view along plane VII of FIG. 5 when the actuation member 22 is in the second relative position relative to the carrier member 21. Each locking pawl 31 is now positioned offset from the respective recess 36 in a circumferential direction. Each locking pawl is located radially inwardly of a section of the surface portion 35 which disengages the locking pawl 31 from the recesses of the profile 32. The actuation member 22 prevents the locking pawl 31 from snapping into corresponding recesses of the profile 32, as shown in FIG. 8. The actuation member 22 can rotate the carrier member 21 in the second rotation direction 52.

Figure 10:
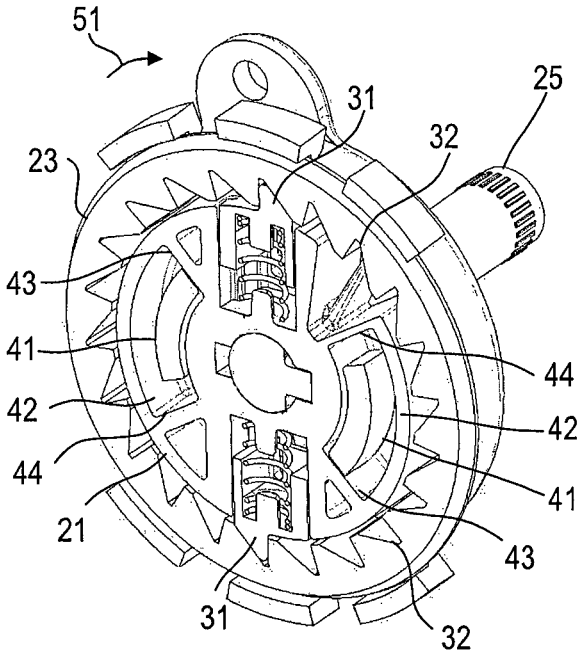
FIG. 10 is a partially cut-away perspective view of the tension adjust device during a tension increase operation.
Figure 11:
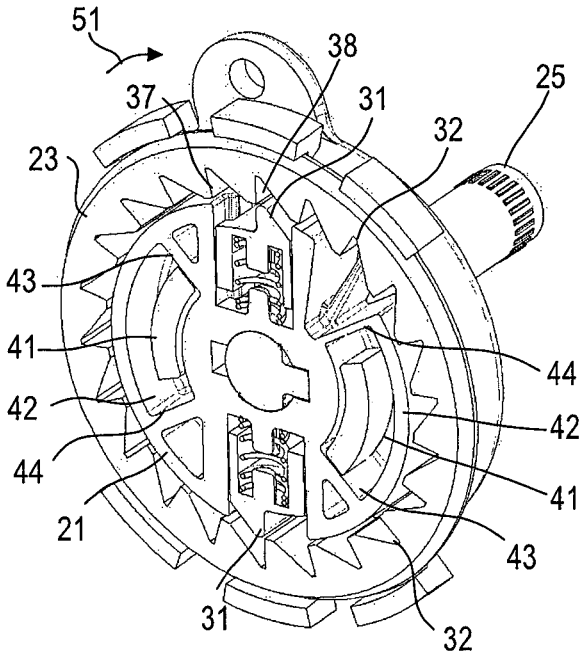
FIG. 11 is a partially cut-away perspective view of the tension adjust device during the tension increase operation when a locking pawl has just passed over a tooth.
Figure 12:
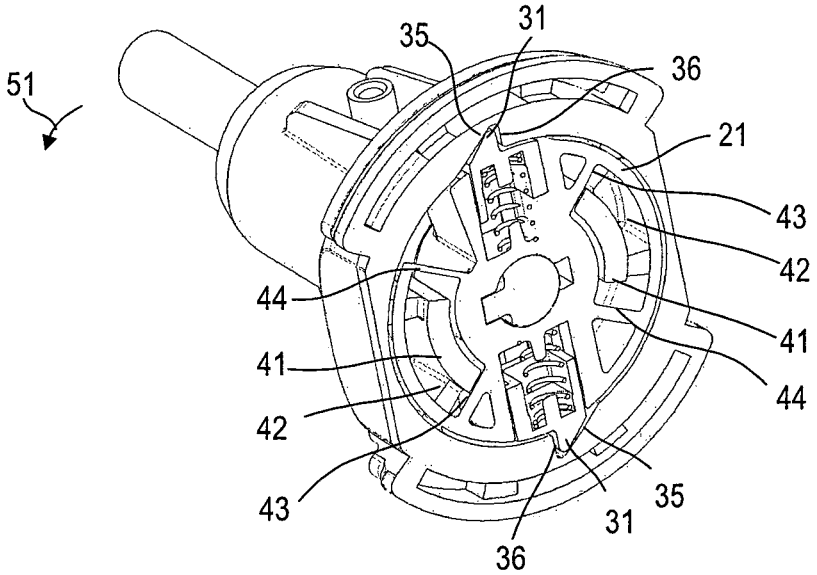
FIG. 12 is a partially cut-away perspective view of the tension adjust device during the tension increase operation.

FIG. 10 and FIG. 11 are partially cut-away perspective views of the tension adjust device as seen from plane VI in FIG. 5 when the actuation member 22 rotates the carrier member 21 in the first rotation direction 51. FIG. 12 is a partially cut-away perspective view of the tension adjust device as seen from plane VII in FIG. 5 when the actuation member 22 rotates the carrier member 21 in the first rotation direction 51, but with a viewing direction away from the shaft 25. The change in viewing direction in FIG. 12 as compared to FIG. 10 and FIG. 11 results in that the projection 41 seen on the left-hand side in FIG. 10 and FIG. 11 is located on the right-hand side in FIG. 12, etc. The actuation member 22 is in the first relative position relative to the carrier member 21. In the first relative position between actuation member 22 and carrier member 21, each locking pawl 31 is located adjacent to and radially inward of the associated recess 36. This allows the locking pawl 31 to snap into recesses of the profile 32. The ratchet mechanism does not prevent rotation of the actuation member 22 and carrier member 21 in the first rotation direction, as seen in FIG. 11 which shows the mechanism in a state in which the locking pawl 31 just slid over a gently inclined surface of a ratchet tooth between recesses 37 and 38.

Figure 13:
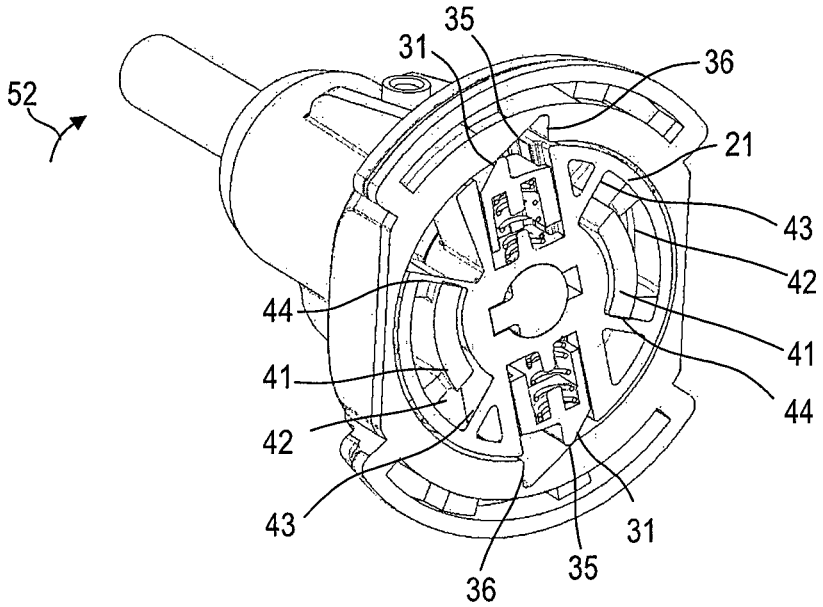
FIG. 13 is a partially cut-away perspective view of the tension adjust device during the tension decrease operation.

FIG. 13 is a partially cut-away perspective view of the tension adjust device as seen from plane VII in FIG. 5 when the actuation member 22 rotates the carrier member 21 in the second rotation direction 52, but with a viewing direction away from the shaft 25. The actuation member 22 is in the second relative position relative to the carrier member 21. In the second relative position between actuation member 22 and carrier member 21, each locking pawl 31 is located adjacent to and radially inward of the surface portion 35 on the inner surface of the actuation member 22 which pushes the locking pawl 31 out of engagement with teeth of the profile 32. This prevents the locking pawl 31 from snapping into recesses of the profile 32. The ratchet mechanism does not prevent rotation of the actuation member 22 and carrier member 21 in the second rotation direction 52, because the disengagement mechanism maintains the ratchet mechanism in the disengaged state as long as the actuation member 22 rotates the carrier member 21 in the second direction 52.

The tension adjust device of embodiments may be used for tension adjustment on a wide variety of adjustable chair subassemblies. The shaft 25 or another output member of the tension adjust device may be operative to increase or decrease the energy stored in an energy storage mechanism. The shaft 25 or another output member of the tension adjust device may be operative to adjust a lever arm length at which the energy storage mechanism applies a force.

Figure 14:
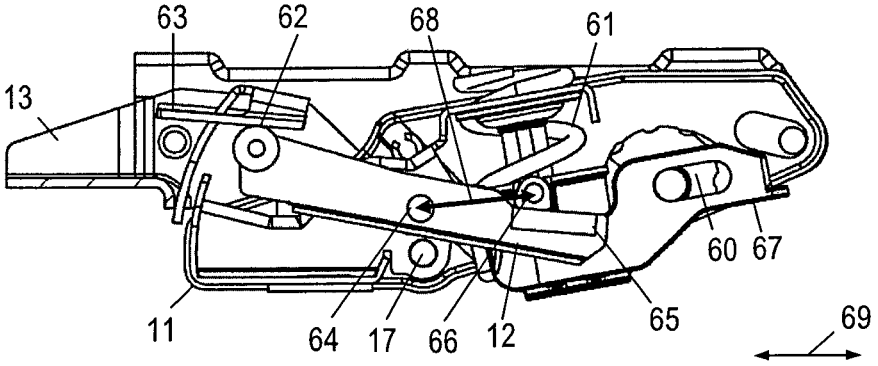
FIG. 14 is a sectional view of an adjustable recline subassembly which may be used in a chair of an embodiment.
Figure 15:
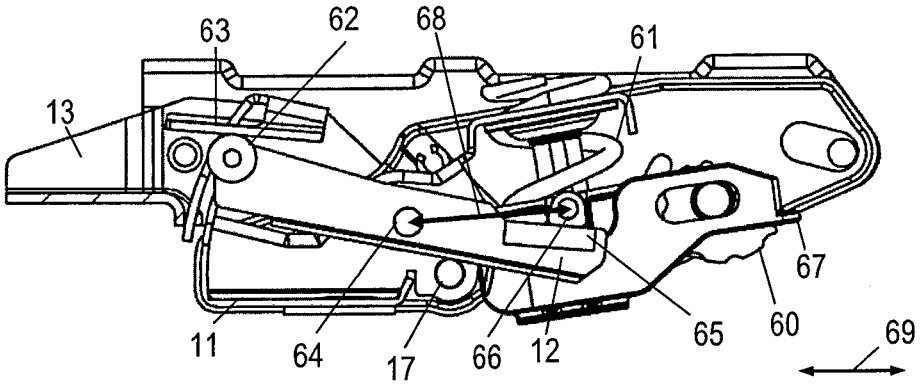
FIG. 15 is a sectional view of the adjustable recline subassembly after completion of a tension increase operation.
Figure 16:
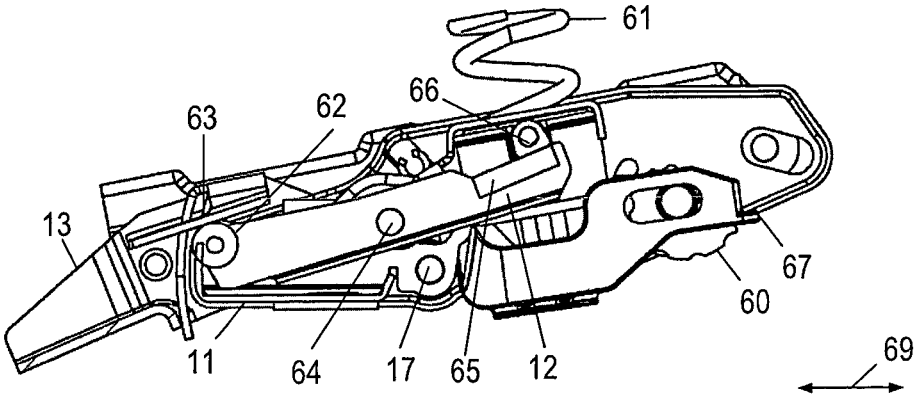
FIG. 16 is a sectional view of the adjustable recline subassembly after completion of a tension increase operation and when the user reclines.

An exemplary implementation of an adjustable subassembly for which the tension adjust device may be used will be explained with reference to FIG. 14 to FIG. 16. The adjustable subassembly is configured as a tilt mechanism which provides support to the user as the user reclines the chair back.

The tilt mechanism generally includes a base 11. The tension adjust device may be mounted to the base such that the carrier member, the actuation member, the ratchet mechanism and the disengagement mechanism are all located at an outer side of a side wall of the base. Alternatively, some of the components may extend into the base 11.

A back bracket 13 is supported on the base 11. The back bracket 13 is mounted so as to pivot about a tilt axis 17. The tilt axis 17 may be stationary relative to the base 11. During recline, an increasing torque is applies onto the back bracket 13 and, thus, the chair back. To this end, an energy storage mechanism 61 is used. The energy storage mechanism 61 may comprise a spring, e.g. a coil spring, or another resiliently deformable energy storage mechanism. To exert a torque onto the chair back, there is provided a rocker 12. The rocker 12 is mounted so as to be pivotable relative to the base 11. The rocker 12 may be mounted to the base 11 at a pivot axis 64, about which the rocker 12 pivots and which is stationary relative to the rocker 12.

The rocker 12 is coupled to the back bracket 13. For illustration, the rocker 12 may have a roller 62 at its rear end which abuts on an abutment surface 63 on the back bracket 13. This coupling causes the rocker 12 to pivot about the pivot axis 64 as the back bracket 13 pivots about the tilt axis 17. The resultant pivoting movement of the rocker 12 causes a front section 65 of the rocker 12 to be raised or lowered, thereby further compressing the spring or allowing the spring to be decompressed. Torque is increased to support the user as the user reclines further.

The tension adjust device can be coupled to the tilt mechanism in various ways. In one implementation, as illustrated in FIG. 14 to FIG. 16, the shaft 25 of the tension adjust device may be coupled to a cam 60. Rotation of the cam 60 causes the rocker 12 and the energy storage mechanism 61 to be displaced relative to each other. For illustration, rotation of the cam 60 may cause the base 11 with the rocker 12 supported thereon to be displaced relative to a support 67 on which the energy storage mechanism 61 is mounted. This is illustrated in FIG. 14 and FIG. 15. By rotating the cam 60, the location at which the energy storage mechanism applies a force onto the rocker 12 may be shifted relative to the pivot axis 64, e.g. by displacing the rocker 12 in a forward-backward-direction 69. Accordingly, a lever arm length may be changed. The lever arm length is a distance 68 between the pivot axis and the location at which the energy storage mechanism 61 applies a force onto the rocker. As shown in FIG. 14 and FIG. 15, rotation of the cam 60 causes the lever arm length 68 to change. A slider 66 of the energy storage mechanism may slide along a corresponding abutment surface 65 on the rocker 12 during such an adjustment. A transition from the configuration shown in FIG. 14 to the configuration shown in FIG. 15 increases the lever arm length of the energy storage mechanism, thereby increasing tension. Such an adjustment may be brought about when the actuation member 22 of the tension adjust device is rotated in the first rotation direction, leading to a corresponding rotation of the cam 60. A transition from the configuration shown in FIG. 15 to the configuration shown in FIG. 14 decreases the lever arm length of the energy storage mechanism, thereby decreasing tension. Such an adjustment may be brought about when the actuation member 22 of the tension adjust device is rotated in the second rotation direction. The resulting rotation of the shaft 25 leads to a corresponding rotation of the cam 60. When the user reclines, as shown in FIG. 16, the back bracket 13 pivots about axis 17, causing the rocker 12 to pivot about pivot axis 64. The resultant movement of the abutment surface 65 compresses the spring of the energy storage mechanism, thereby providing increased torque. Even if the movement of the rocker 12 exerts a force onto the cam 60, the ratchet mechanism prevents an undesired rotation of the actuation member of the tension adjust device.

It will be appreciated that the tension adjust device may be used with a wide variety of other adjustable chair subassemblies. For illustration, the tension adjust device may be coupled to an adjustable subassembly such that rotation of the actuation member 22 in the first direction causes the energy stored in an energy storage mechanism to be increased, while rotation of the actuation member 22 in the second direction causes the energy stored in an energy storage mechanism to be decreased. For illustration rather than limitation, the tension adjust device of an embodiment may be used in combination with any one of the tilt mechanisms disclosed in PCT/EP2011/003276.

While tension adjust devices according to embodiments have been described in detail with reference to the drawings, modifications thereof may be implemented in further embodiments. For illustration, the tension adjust device does not need to be attached at an outer side face of a core of an adjustable subassembly. At least some components of the tension adjust device may be located within the core and may be enclosed by the base.

For further illustration, while implementations of the tension adjust device are shown in the drawings in which the profile of the ratchet mechanism is arranged on a stationary lock ring and the locking pawl is arranged on a rotatable carrier member, other configuration may be used. For illustration, the locking pawl may be arranged on a stationary member so as to be linearly or rotationally displaceable, while the profile of the ratchet mechanism may be formed on a rotatable carrier member.

For further illustration, while implementations of a disengagement mechanism were described in which the actuation member is rotatable relative to the carrier member by a small angle, to thereby displace the locking pawl in a radial direction and out of engagement with the profile of the ratchet mechanism, other implementations can be used. The actuation member and the carrier member may be axially moveable relative to the lock ring with the profile. In a first axial position, which may be selected for a tension increase operation, the locking pawls can engage the profile of the lock ring. Accordingly, undesired back action of the energy storage mechanism of the adjustable subassembly onto the tension adjust device may be prevented by the ratchet mechanism in the tension increase operation. In a second axial position, which may be selected for a tension decrease operation, the locking pawls are axially offset from the profile such that they cannot engage the profile of the lock ring. Accordingly, the ratchet mechanism does not interfere with the tension decrease operation.

For further illustration, while energy storage mechanisms comprising a spring have been explained in the context of some embodiments, any resiliently deformable member may be used.

For further illustration, while a coupling between a shaft of the tension adjust device and a cam of a tilt mechanism has been described, a variety of other coupling arrangements may be used, including a worm gear, wedges, or one or several cams, without being limited thereto.

While exemplary embodiments have been described in the context of office-type chairs, the tension adjust devices and chairs according to embodiments of the invention are not limited to this particular application. Rather, embodiments of the invention may be employed to realize a tension adjust feature in adjustable chair subassemblies for a wide variety of chairs.

The invention claimed is:

1. A tension adjust device for a chair, the tension adjust device comprising:

a carrier member;

an actuation member rotatable in a first direction and in a second direction opposite to the first direction, the actuation member being configured to rotate the carrier member;

a ratchet mechanism coupled between the actuation member and the carrier member, the ratchet mechanism comprising a locking pawl and a profile having a plurality of recesses for engagement with the locking pawl; and a disengagement mechanism configured to maintain the ratchet mechanism in a disengaged state when the actuation member rotates the carrier member in the second direction, the locking pawl remaining disengaged from the recesses of the profile while the ratchet mechanism is in the disengaged state, wherein the disengagement mechanism selectively disengages the ratchet mechanism depending on a rotation direction of the actuation member and the carrier member.

2. The tension adjust device of claim 1, wherein the actuation member is displaceable relative to the carrier member between a first relative position and a second relative position, and wherein the disengagement mechanism is configured to maintain the ratchet mechanism in the disengaged state while the actuation member is in the second relative position relative to the carrier member.

3. The tension adjust device of claim 2, wherein the actuation member is rotatable relative to the carrier member, and wherein the disengagement mechanism is configured to transfer the ratchet mechanism into the disengaged state when the actuation member is rotated into the second relative position relative to the carrier member.

4. The tension adjust device of claim 3, wherein the disengagement mechanism comprises a surface formed on the actuation member and configured to displace the locking pawl when the actuation member is rotated into the second relative position relative to the carrier member.

5. The tension adjust device of claim 3, wherein one of the actuation member and the carrier member has a projection, and the other one of the actuation member and the carrier member has a first end stop and a second end stop which are positioned such that the projection abuts on the first end stop when the actuation member is in the first relative position relative to the carrier member and that the projection abuts on the second end stop when the actuation member is in the second relative position relative to the carrier member.

6. The tension adjust device of claim 5, wherein the actuation member and the carrier member have a rotation axis, wherein the projection is curved about the rotation axis and protrudes into a guide recess which is curved about the rotation axis, and wherein the first end stop is a first end surface of the guide recess and the second end stop is an opposing second end surface of the guide recess.

7. The tension adjust device of claim 1, wherein the carrier member carries the locking pawl, the locking pawl being biased in a direction perpendicular to a rotation axis of the carrier member.

8. The tension adjust device of claim 1, wherein the profile is formed on an inner surface of a lock ring, and wherein the carrier member is arranged in a cavity defined between the actuation member and the lock ring.

9. A chair, comprising:

a base, an adjustable subassembly which comprises a chair component moveable relative to the base and an energy storage mechanism coupled to the chair component, and the tension adjust device of claim 1.

10. The chair of claim 9, wherein the tension adjust device is integrated into a handle which projects from the adjustable subassembly.

11. The chair of claim 10, wherein the adjustable subassembly comprises a lateral side wall, and wherein the handle with the tension adjust device is attached at an outer side of the lateral side wall.

12. The chair of claim 9, wherein the tension adjust device is coupled to the adjustable subassembly to increase a tension of the adjustable subassembly when the actuation member rotates the carrier member in the first direction and to decrease the tension of the adjustable subassembly when the actuation member rotates the carrier member in the second direction.

13. The chair of claim 9, wherein the tension adjust device is coupled to the energy storage mechanism and is configured to adjust a pretension and/or a lever arm length of the energy storage mechanism.

14. The chair of claim 9, wherein the chair component comprises a chair back; and wherein the adjustable subassembly further comprises:

a back bracket tiltably supported on the base and attached to the chair back, a rocker having a pivot axis provided at a fixed location relative to the rocker, the rocker being coupled to the back bracket so as to be moveable relative to the back bracket and being configured such that the rocker pivots about the pivot axis when the back bracket tilts relative to the base;

wherein the energy storage mechanism is coupled to the rocker to exert a force onto a portion of the rocker, the portion being spaced from the pivot axis by a distance.

15. The chair of claim 14, wherein the tension adjust device is coupled to at least one of the rocker or the energy storage mechanism and is configured to alter the distance between the pivot axis and the portion of the rocker at which the force is exerted onto the rocker.

* * * * *